US011117006B1

(12) United States Patent
Aryee

(10) Patent No.: US 11,117,006 B1
(45) Date of Patent: Sep. 14, 2021

(54) AUTOMATIC FIRE EXTINGUISHER

(71) Applicant: Frederick Aryee, San Diego, CA (US)

(72) Inventor: Frederick Aryee, San Diego, CA (US)

( * ) Notice: Subject to any disclaimer, the term of this patent is extended or adjusted under 35 U.S.C. 154(b) by 146 days.

(21) Appl. No.: 16/437,005

(22) Filed: Jun. 11, 2019

Related U.S. Application Data

(63) Continuation-in-part of application No. 15/936,722, filed on Mar. 27, 2018, now Pat. No. 10,814,152.

(51) Int. Cl.
*A62C 19/00* (2006.01)
*A62C 31/05* (2006.01)

(52) U.S. Cl.
CPC ..... *A62C 19/00* (2013.01); *A62C 31/05* (2013.01)

(58) Field of Classification Search
CPC ..... A62C 19/00; A62C 31/05; A62C 99/0027
USPC ..... 169/28, 36, 44, 46, 54
See application file for complete search history.

(56) References Cited

U.S. PATENT DOCUMENTS

D307,647 S 5/1990 Yasuo
5,315,292 A 5/1994 Prior
6,540,155 B1 4/2003 Yahav
7,172,031 B2 2/2007 Piatti
7,182,144 B2 2/2007 Baba
8,434,411 B2 * 5/2013 Daoud ..... F42B 12/207 102/497
8,607,888 B2 12/2013 Nusbaum
8,973,671 B2 3/2015 Alsaif
9,345,914 B1 5/2016 Haji
2016/0136468 A1 * 5/2016 Kosovski-Shahor .. A62C 13/76 169/46

FOREIGN PATENT DOCUMENTS

WO 2008103282 A 8/2008

* cited by examiner

*Primary Examiner* — Qingzhang Zhou

(57) ABSTRACT

The automatic fire extinguisher is a fire retardant dispensing device. The automatic fire extinguisher is an automated device. The automatic fire extinguisher is an explosive device. The automatic fire extinguisher is a temperature sensitive device that releases a fire retardant in the form of a gas when a predetermined ambient temperature has been reached. The automatic fire extinguisher comprises a compressed retardant gas, a high-pressure gas tank, and an explosive device. The high-pressure gas contains the compressed retardant gas and the explosive device. The explosive device detonates when the ambient temperature reaches when the predetermined ambient temperature is reached. The explosion of the explosive device ruptures the high-pressure gas tank thereby releasing and dispersing the compressed retardant gas into the atmosphere.

10 Claims, 4 Drawing Sheets

AUTOMATIC FIRE EXTINGUISHER

CROSS REFERENCES TO RELATED APPLICATIONS

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety.

STATEMENT REGARDING FEDERALLY SPONSORED RESEARCH

Not Applicable

REFERENCE TO APPENDIX

Not Applicable

BACKGROUND OF THE INVENTION

The present invention relates to the field of life-saving including firefighting equipment, more specifically, fire extinguishing equipment for area conflagrations.

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety. Within this disclosure, the non-provisional application U.S. Ser. No. 15/936,722 will also be referred to as the prior disclosure.

The present disclosure will only reference the elements of the non-provisional application U.S. Ser. No. 15/936,722 that are relevant to the innovations disclosed within this application. This is done for purposes of simplicity and clarity of exposition. The applicant notes that this disclosure incorporates non-provisional application U.S. Ser. No. 15/936,722 in its entirety into this application. The fact that any specific innovation selected from the one or more innovations disclosed within U.S. Ser. No. 15/936,722 is not addressed in this application should not be interpreted as an indication of defect in the above-referenced patent.

A summary of the disclosures contained within the prior disclosure that are relevant to the present disclosure is provided below. This summary is provided for clarity and convenience and is not intended to fully represent or reflect the disclosures contained within the prior disclosure. If a discrepancy occurs between this summary and the prior disclosure, the prior disclosure should be considered correct and this summary should be considered in error.

The prior disclosure discloses an automated fire retardant dispensing device. The prior disclosure is a self-contained device with a single moving part. The prior disclosure is a temperature sensitive device that releases a fire retardant in the form of a compressed gas when a predetermined ambient temperature has been reached. The prior disclosure comprises a compressed retardant gas, a high-pressure gas tank, and a release valve. The release valve releases the compressed retardant gas from the high-pressure gas tank into the atmosphere. The prior disclosure identifies the compressed retardant gas as diatomic nitrogen.

The release valve is a normally open spring loaded valve. The release valve is held in a closed position using a thermal epoxy detent. The thermal epoxy detent holds the spring in a deformed position such that the release valve is locked in a closed position. When the predetermined ambient temperature has been reached, the thermal epoxy detent melts thereby opening the release valve in the open position and releasing the compressed retardant gas into the atmosphere.

SUMMARY OF INVENTION

The automatic fire extinguisher is a fire retardant dispensing device. The automatic fire extinguisher is an automated device. The automatic fire extinguisher is an explosive device. The automatic fire extinguisher is a temperature sensitive device that releases a fire retardant in the form of a gas when a predetermined ambient temperature has been reached. The automatic fire extinguisher comprises a compressed retardant gas, a high-pressure gas tank, and an explosive device. The high-pressure gas contains the compressed retardant gas and the explosive device. The explosive device detonates when the ambient temperature reaches when the predetermined ambient temperature is reached. The explosion of the explosive device ruptures the high-pressure gas tank thereby releasing and dispersing the compressed retardant gas into the atmosphere.

These together with additional objects, features and advantages of the automatic fire extinguisher will be readily apparent to those of ordinary skill in the art upon reading the following detailed description of the presently preferred, but nonetheless illustrative, embodiments when taken in conjunction with the accompanying drawings.

In this respect, before explaining the current embodiments of the automatic fire extinguisher in detail, it is to be understood that the automatic fire extinguisher is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the automatic fire extinguisher.

It is therefore important that the claims be regarded as including such equivalent construction insofar as they do not depart from the spirit and scope of the automatic fire extinguisher. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
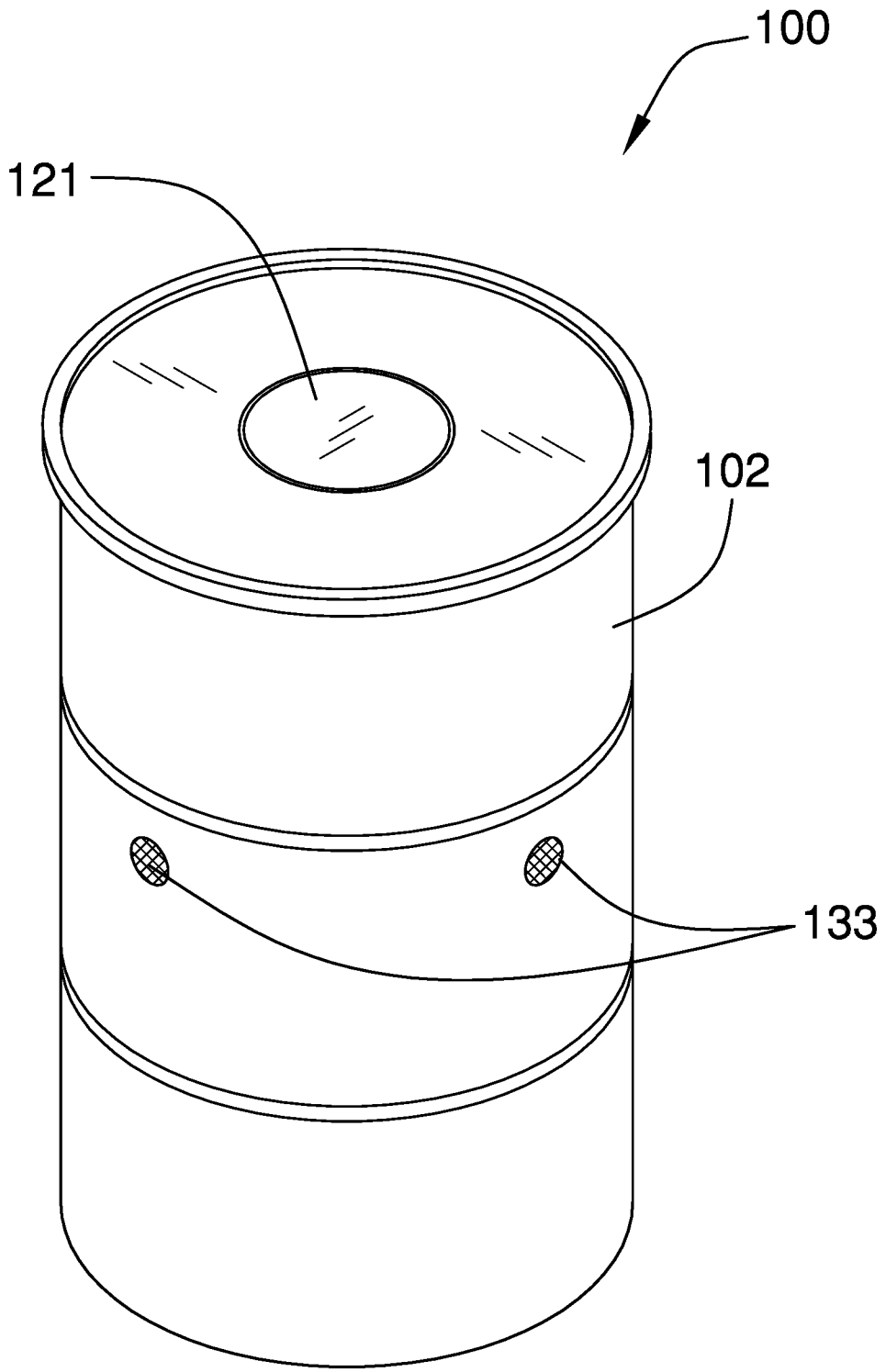
FIG. 1 is a perspective view of an embodiment of the disclosure.
Figure 2:
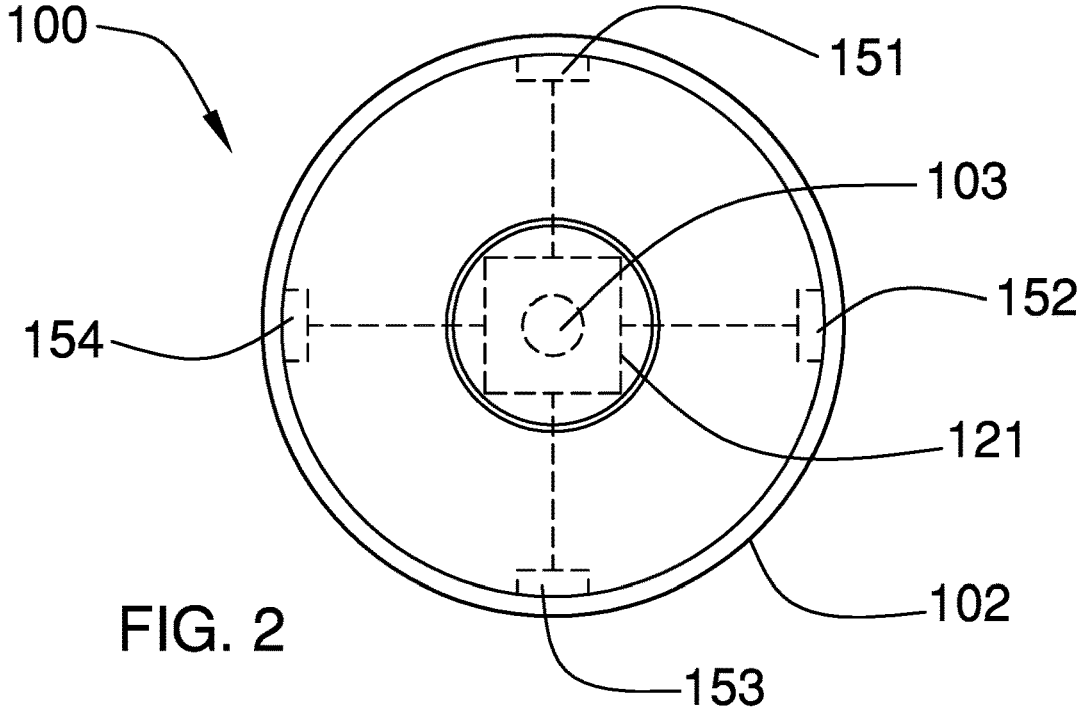
FIG. 2 is a top view of an embodiment of the disclosure.
Figure 3:
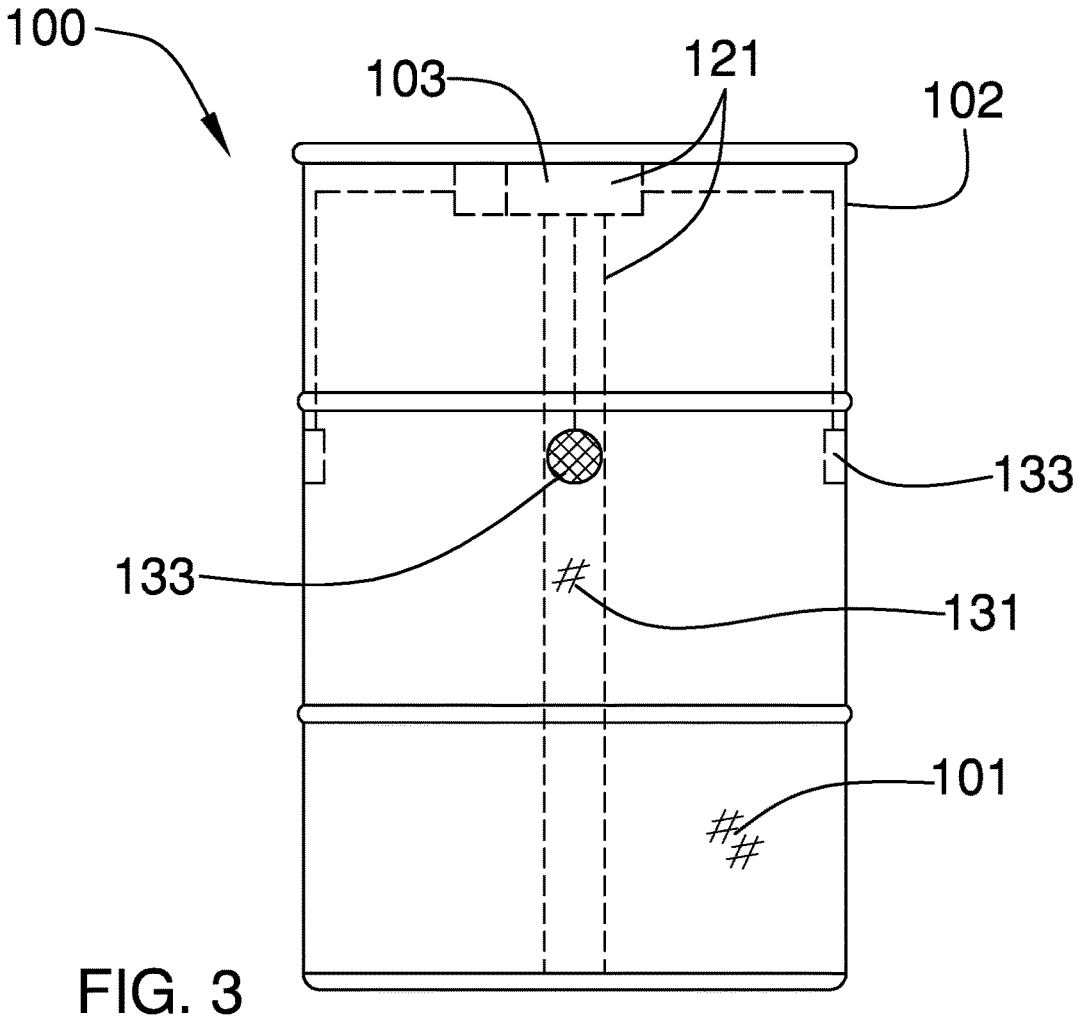
FIG. 3 is a front view of an embodiment of the disclosure.
Figure 4:
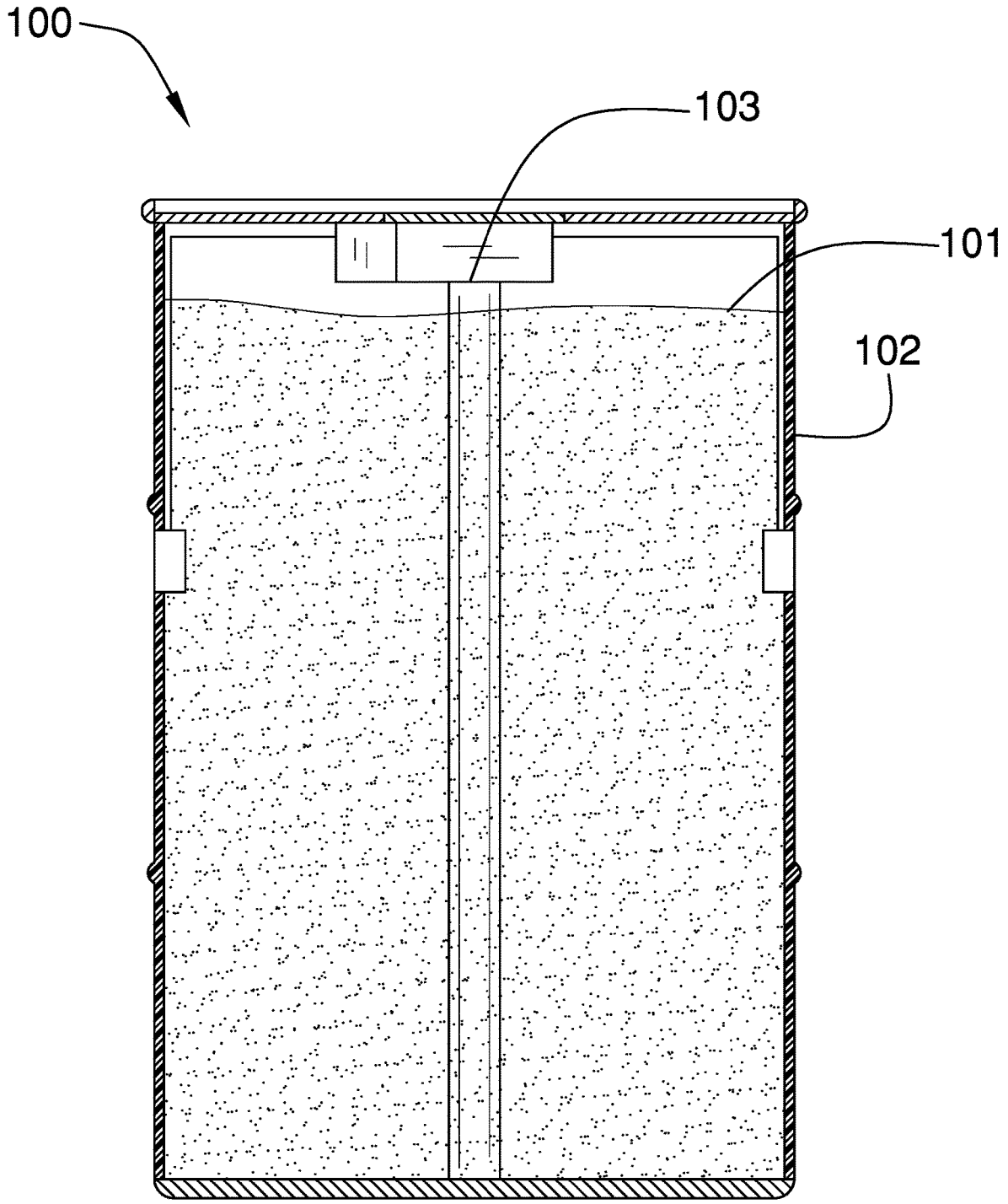
FIG. 4 is a cross-sectional view of an embodiment of the disclosure.
Figure 5:
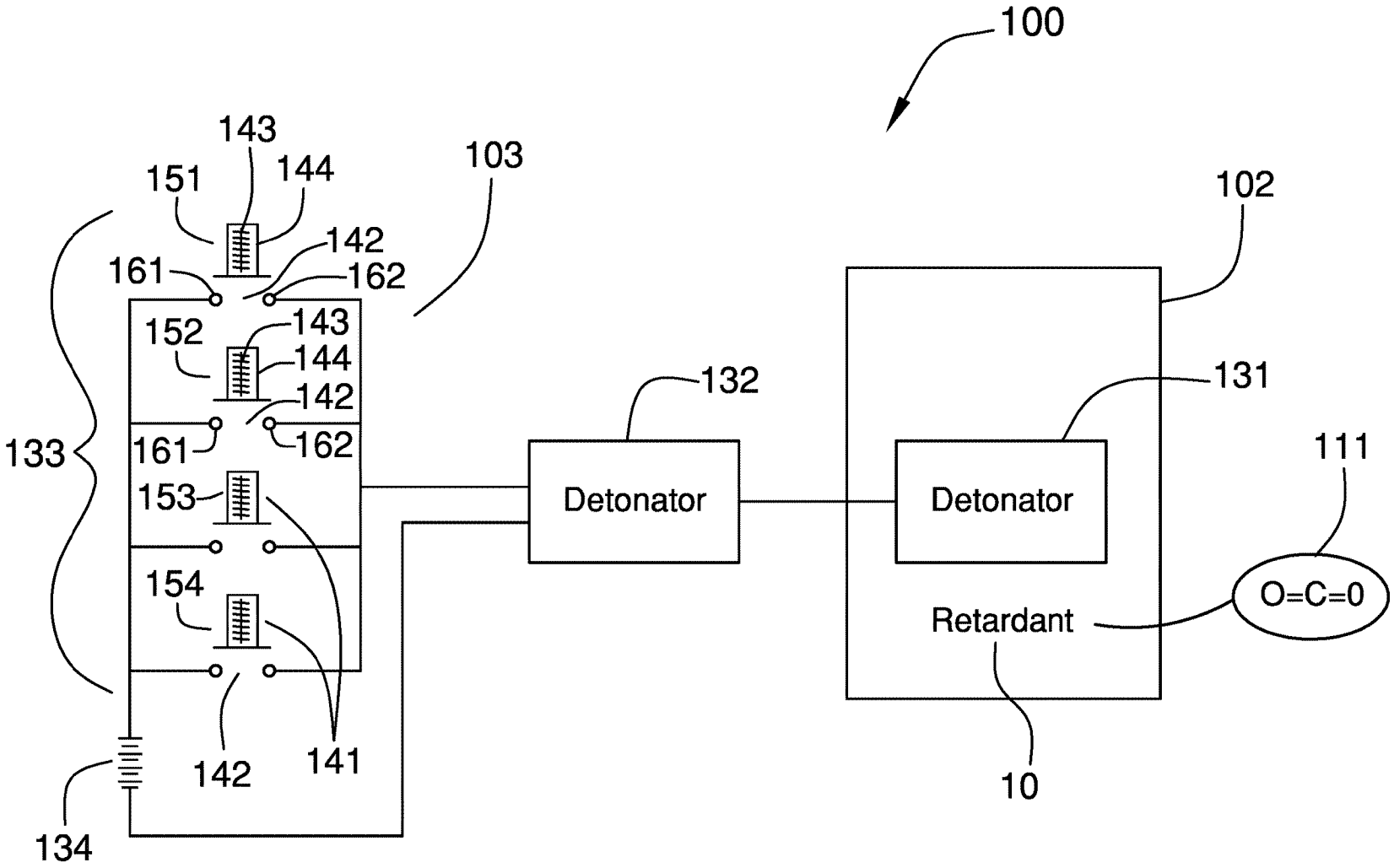
FIG. 5 is a block diagram of an embodiment of the disclosure.

Detailed reference will now be made to one or more potential embodiments of the disclosure, which are illustrated in FIGS. 1 through 5.

This non-provisional application is a continuation-in-part application filed under 37 CFR 1.53(b) that claims the benefit of United States 35 USC 120 from non-provisional application Ser. No. 15/936,722 filed on Mar. 27, 2018, by the inventor: Fredrick Aryee of San Diego, Calif. This non-provisional application incorporates non-provisional application Ser. No. 15/936,722 in its entirety. Within this disclosure, the non-provisional application U.S. Ser. No. 15/936,722 will also be referred to as the prior disclosure.

The present disclosure will only reference the elements of the non-provisional application U.S. Ser. No. 15/936,722 that are relevant to the innovations disclosed within this application. This is done for purposes of simplicity and clarity of exposition. The applicant notes that this disclosure incorporates non-provisional application U.S. Ser. No. 15/936,722 in its entirety into this application. The fact that any specific innovation selected from the one or more innovations disclosed within U.S. Ser. No. 15/936,722 is not addressed in this application should not be interpreted as an indication of defect in the above-referenced patent.

The automatic fire extinguisher 100 (hereinafter invention) is a fire retardant dispensing device. The invention 100 is an automated device. The invention 100 is an explosive device 103. The invention 100 is a temperature sensitive device that releases a fire retardant in the form of a gas when a predetermined ambient temperature has been reached. The invention 100 comprises a compressed retardant gas 101, a high-pressure gas tank 102, and an explosive device 103. The high-pressure gas tank 102 contains the compressed retardant gas 101 and the explosive device 103. The explosive device 103 detonates when the ambient temperature reaches when the predetermined ambient temperature is reached. The explosion of the explosive device 103 ruptures the high-pressure gas tank 102 thereby releasing and dispersing the compressed retardant gas 101 into the atmosphere. This disclosure assumes that the invention 100 is configured for outdoor use.

The compressed retardant gas 101 is an inert gas. The high-pressure gas tank 102 contains the compressed retardant gas 101 in a phase selected from the group consisting of a solid phase, a liquid phase, and a compressed gas phase. The compressed retardant gas 101 is selected such that the release of the compressed retardant gas 101 is released into the atmosphere in a gas phase. The compressed retardant gas 101 is selected such that the release of the compressed retardant gas 101 inhibits the combustion reaction of an existing fire. The combustion reaction is defined in greater detail elsewhere in this disclosure. Specifically, the compressed retardant gas 101 reduces the concentration of oxygen available for use as a reactant in the combustion reaction.

The compressed retardant gas 101 is selected such that the molecular weight of the compressed retardant gas 101 is greater than the molecular weight of diatomic oxygen such that the diatomic oxygen close to the ground is displaced by the compressed retardant gas 101. This increases the effectiveness of the invention 100 in outdoor fires because of the tendency of an outdoor file to remain close to the ground.

In the first potential embodiment of the compressed retardant gas 101 is carbon dioxide 111. The carbon dioxide 111 is loaded into the high-pressure gas tank 102 in a solid phase (commonly known as dry ice). As the temperature of the carbon dioxide 111 increases within the high-pressure gas tank 102, the pressure of the carbon dioxide 111 within the high-pressure gas tank 102 increases. The carbon dioxide 111 is defined in greater detail elsewhere in this disclosure.

The high-pressure gas tank 102 is a high-pressure rated containment structure. The high-pressure gas tank 102 contains the compressed retardant gas 101 under pressure. The high-pressure gas tank 102 is selected such that the rating of the compressed retardant gas 101 is sufficient to safely contain the compressed retardant gas 101 at the anticipated pressures. The high-pressure gas tank 102 further comprises an internal housing 121.

The internal housing 121 is a rigid casing. The internal housing 121 is contained within the high-pressure gas tank 102. The internal housing 121 contains the explosive device 103. The internal housing 121 is formed with all apertures and form factors necessary to allow the internal housing 121 to accommodate the use and operation of the explosive device 103. Methods to form an internal housing 121 suitable for the purposes described in this disclosure are well-known and documented in the mechanical arts.

The explosive device 103 is a chemical device. The explosive device 103 is based on an explosive compound. The high-pressure gas tank 102 is designed to rupture when the explosive device 103 detonates. The detonation of the explosive device 103 releases and disperses the compressed retardant gas 101 into the atmosphere. The explosive device 103 comprises an explosive material 131, a detonator 132, a plurality of thermal switches 133, and a battery 134.

The explosive material 131 is an explosive chemical compound. An explosive chemical compound is defined in greater detail elsewhere in this disclosure. The explosive material 131 is selected such that the detonation of the explosive material 131 generates a shock wave that travels through the interior of the high-pressure gas tank 102 with adequate force to rupture the high-pressure gas tank 102. The rupture of the high-pressure gas tank 102 releases and disperses the compressed retardant gas 101 into the atmosphere such that the dispersal of the compressed retardant gas 101 inhibits the combustion reaction of the fire.

The detonator 132 is an electrically powered device. The detonator 132 interconnects with the explosive material 131 such that the detonator 132 initiates the explosion of the explosive material 131. The actuation of a single individual thermal switch 141 selected from the plurality of thermal switches 133 initiates the operation of the detonator 132. The detonator 132 is defined in greater detail elsewhere in this disclosure.

The battery 134 is an electrochemical device. The battery 134 converts chemical potential energy into the electrical energy used to power the detonator 132.

Each of the plurality of thermal switches 133 is a momentary switch. Each of the plurality of thermal switches 133 is designed to actuate when the ambient temperature surrounding the high-pressure gas tank 102 exceeds the predetermined ambient temperature of the invention 100. The actuation of an individual thermal switch 141 selected from the plurality of thermal switches 133 initiates the operation of the detonator 132 and the explosion of the explosive material 131. The plurality of thermal switches 133 comprises a collection of individual thermal switches 141.

The individual thermal switch 141 is an electrical switching device. Each individual thermal switch 141 electrically connects in series between the battery 134 and the detonator 132 such that the closure of the individual thermal switch 141 provides the electrical energy required by the detonator 132 to detonate the explosive material 131. Each individual thermal switch 141 comprises a normally closed momentary switch 142, a switch compression spring 143, and a thermal epoxy detent 144.

The normally closed momentary switch 142 is a well-known and documented electrical device. The normally closed momentary switch 142 forms the series electrical connection between the battery 134 and the detonator 132. The normally closed momentary switch 142 controls the flow of electricity from the battery 134 into the detonator 132. The normally closed momentary switch 142 further comprises a first lead 161 and a second lead 162.

The switch compression spring 143 is a compression spring that holds the normally closed momentary switch 142 in the closed position when the switch compression spring 143 is in its relaxed shape. The actuation of the normally closed momentary switch 142 into an open position applies a compressive force to the switch compression spring 143 such that the switch compression spring 143 will return to its relaxed shape to close the normally closed momentary switch 142 when the compressive force is removed.

The thermal epoxy detent 144 is an epoxy adhesive used to glue the switch compression spring 143 of the normally closed momentary switch 142 in a deformed position such that the normally closed momentary switch 142 is fixed into an open position. The thermal epoxy detent 144 is formed from a thermal epoxy. The thermal epoxy detent 144 is a form of epoxy that is designed to melt at a predetermined temperature.

In the first potential embodiment of the disclosure, the predetermined temperature of the thermal epoxy used in the thermal epoxy detent 144 is the predetermined ambient temperature of the invention 100. When the temperature around the invention 100 reaches the predetermined ambient temperature, the thermal epoxy forming the thermal epoxy detent 144 melts thereby releasing the switch compression spring 143 of the normally closed momentary switch 142 to close the normally closed momentary switch 142.

The first lead 161 is an electrical termination of the normally closed momentary switch 142. The first lead 161 of the normally closed momentary switch 142 of each individual thermal switch 141 electrically connects to the positive terminal of the battery 134. The second lead 162 is an electrical termination of the normally closed momentary switch 142. The second lead 162 of the normally closed momentary switch 142 of each individual thermal switch 141 electrically connects to the detonator 132.

In the first potential embodiment of the disclosure, the plurality of thermal switches 133 further comprises a first thermal switch 151, a second thermal switch 152, a third thermal switch 153, and a fourth thermal switch 154.

The first thermal switch 151 is an individual thermal switch 141 selected from the plurality of thermal switches 133. The position first thermal switch 151 monitors the temperature by a first quadrant of the exterior of the high-pressure gas tank 102.

The second thermal switch 152 is an individual thermal switch 141 selected from the plurality of thermal switches 133. The position second thermal switch 152 monitors the temperature by a second quadrant of the exterior of the high-pressure gas tank 102.

The third thermal switch 153 is an individual thermal switch 141 selected from the plurality of thermal switches 133. The position third thermal switch 153 monitors the temperature by a third quadrant of the exterior of the high-pressure gas tank 102.

The fourth thermal switch 154 is an individual thermal switch 141 selected from the plurality of thermal switches 133. The position fourth thermal switch 154 monitors the temperature by a fourth quadrant of the exterior of the high-pressure gas tank 102.

The second thermal switch 152 electrically connects in parallel with the first thermal switch 151. The third thermal switch 153 electrically connects in parallel with the first thermal switch 151 and the second thermal switch 152. The fourth thermal switch 154 electrically connects in parallel with the first thermal switch 151, the second thermal switch 152, and the third thermal switch 153.

The following definitions were used in this disclosure:

Atmosphere: As used in this disclosure, the atmosphere refers to a blanket of gases (primarily nitrogen and oxygen) that surround the earth. Typical atmospheric conditions are approximated and characterized as the normal temperature and pressure. Atmospheric gases are commonly called air.

Battery: As used in this disclosure, a battery is a chemical device consisting of one or more cells, in which chemical energy is converted into electricity and used as a source of power. Batteries are commonly defined with a positive terminal and a negative terminal.

Carbon Dioxide: As used in this disclosure, carbon dioxide (CAS 124-38-9) refers to a chemical compound with the formula CO2. In the solid phase, carbon dioxide is often referred to as dry ice.

Chamber: As used in this disclosure, a chamber is an enclosed or enclosable space that is dedicated to a purpose.

Combustion: As used in this disclosure, combustion refers to a reduction-oxidation reaction wherein oxygen and a hydrocarbon are combined to release energy, carbon dioxide, and water. In general usage, the meaning of combustion is often extended to describe a reaction between oxygen and a fuel source, such as a hydrocarbon modified by functional groups, which releases energy.

Compress: In this disclosure, compress means to force into a smaller space.

Compressed Gas: In this disclosure, compressed gas refers to a gas that has been compressed to a pressure greater than atmospheric pressure.

Detent: As used in this disclosure, a detent is a device for positioning and holding a first object relative to a second object such that the position of the first object relative to the second object is adjustable.

Detonator: As used in this disclosure, a detonator is an electrical or a mechanical device used to initiate an exothermic chemical reaction in an explosive. Detonators are commercially available.

Epoxide: As used in this disclosure, an epoxide is a functional group formed by a cyclic ether wherein the first carbon atom of the ether and the second carbon atom of the ether are further joined by a covalent bond.

Epoxy: As used in this disclosure, an epoxy is a polymer-based adhesive that is characterized by the use of an epoxide functional group. Epoxy resin is a synonym for epoxy.

Explosive: As used in this disclosure, an explosive is a chemical compound capable of generating an exothermic reaction that releases energy as an impulse such that the released energy generates a shock wave. The exothermic chemical reaction is referred to as an explosion. Explosive compounds are commercially available.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Ground: As used in this disclosure, the ground is a solid supporting surface formed by the Earth. The term level ground means that the supporting surface formed by the ground is roughly perpendicular to the force of gravity. Always use supporting surface.

High-Pressure Gas Tank: As used in this disclosure, a high-pressure gas tank is a container that is used to store compressed air.

Housing: As used in this disclosure, a housing is a rigid casing that encloses and protects one or more devices.

Impulse: As used in this disclosure, an impulse refers to the release of energy over a relatively short period of time.

Inert: As used in this disclosure, inert is an adjective that is applied to an object, system, or chemical reaction. Inert means that the object, system, or chemical reaction is incapable of motion or activity or is otherwise unreactive.

Liquid: As used in this disclosure, a liquid refers to a state (phase) of matter that is fluid and that maintains, for a given pressure, a fixed volume that is independent of the volume of the container.

Momentary Switch: As used in this disclosure, a momentary switch is a biased switch in the sense that the momentary switch has a baseline position that only changes when the momentary switch is actuated (for example when a pushbutton switch is pushed or a relay coil is energized). The momentary switch then returns to the baseline position once the actuation is completed. This baseline position is called the "normal" position. For example, a "normally open" momentary switch interrupts (open) the electric circuit in the baseline position and completes (closes) the circuit when the momentary switch is activated. Similarly, a "normally closed" momentary switch will complete (close) an electric circuit in the baseline position and interrupt (open) the circuit when the momentary switch is activated.

Phase: As used in this disclosure, phase refers to the state of the form of matter. The common states of matter are solid, liquid, gas, and plasma.

Pressure: As used in this disclosure, pressure refers to a measure of force per unit area.

Reduction-Oxidation Reaction: As used in this disclosure, a reduction-oxidation reaction (also known as a redox reaction) is a chemical reaction involving the transfer of electrons between the reactants of the reaction.

Relaxed Shape: As used in this disclosure, a structure is considered to be in its relaxed state when no shear, strain, or torsional forces are being applied to the structure.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Switch: As used in this disclosure, a switch is an electrical device that starts and stops the flow of electricity through an electric circuit by completing or interrupting an electric circuit. The act of completing or breaking the electrical circuit is called actuation. Completing or interrupting an electric circuit with a switch is often referred to as closing or opening a switch respectively. Completing or interrupting an electric circuit is also often referred to as making or breaking the circuit respectively.

Thermal Epoxy: As used in this disclosure, a thermal epoxy is an epoxy that is designed to melt at a specific temperature. A thermal epoxy is often used to hold a component in a fixed position until the component reaches the melting point of the thermal epoxy. Thermal epoxies are commonly used in the manufacture of "popup thermometers" commonly found in poultry products.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An automatic fire extinguisher comprising a compressed retardant gas, a high-pressure gas tank, and an explosive device;

wherein the high-pressure gas tank contains the compressed retardant gas and the explosive device;

wherein the automatic fire extinguisher is a device that dispenses a fire retardant;

wherein the automatic fire extinguisher is an automated device;

wherein the automatic fire extinguisher is a temperature sensitive device;

wherein the fire retardant is in the form of a gas when a predetermined ambient temperature has been reached;

wherein the explosive device detonates when the ambient temperature reaches when the predetermined ambient temperature is reached;

wherein the explosion of the explosive device ruptures the high-pressure gas tank thereby releasing and dispersing the compressed retardant gas into the atmosphere;

wherein the high-pressure gas tank contains the compressed retardant gas in a phase selected from the group consisting of a solid phase, a liquid phase, and a compressed gas phase;

wherein the compressed retardant gas is selected such that the release of the compressed retardant gas is released into the atmosphere in a gas phase;

wherein the compressed retardant gas is an inert gas;

wherein the compressed retardant gas is selected such that the release of the compressed retardant gas inhibits the combustion reaction of an existing fire;

wherein the compressed retardant gas is selected such that the molecular weight of the compressed retardant gas is greater than the molecular weight of diatomic oxygen;

wherein the high-pressure gas tank is a high-pressure rated containment structure;

wherein the high-pressure gas tank contains the compressed retardant gas under pressure;

wherein the high-pressure gas tank further comprises an internal housing;

wherein the internal housing is a rigid casing;

wherein the internal housing is contained within the high-pressure gas tank;

wherein the internal housing contains the explosive device;

wherein the explosive device is a chemical device;

wherein the explosive device comprises an explosive compound;

wherein the high-pressure gas tank ruptures when the explosive device detonates;

wherein the detonation of the explosive device releases and disperses the compressed retardant gas into the atmosphere;

wherein the explosive device comprises the explosive material, a detonator, a plurality of thermal switches, and a battery;

wherein the explosive material is an explosive chemical compound;

wherein the detonator is an electrically powered device;

wherein the detonator interconnects with the explosive material such that the detonator initiates the explosion of the explosive material;

wherein the actuation of a single individual thermal switch selected from the plurality of thermal switches initiates the operation of the detonator;

wherein the battery is an electrochemical device;

wherein the battery converts chemical potential energy into the electrical energy used to power the detonator;

wherein an explosive material is selected such that the detonation of the explosive material generates a shock wave that travels through the interior of the high-pressure gas tank with a force to rupture the high-pressure gas tank.

2. The automatic fire extinguisher according to claim 1 wherein each of the plurality of thermal switches actuates when the ambient temperature surrounding the high-pressure gas tank exceeds the predetermined ambient temperature of the automatic fire extinguisher.

3. The automatic fire extinguisher according to claim 2 wherein each of the plurality of thermal switches is a momentary switch;

wherein the plurality of thermal switches comprises a collection of individual thermal switches;

wherein the actuation of an individual thermal switch selected from the plurality of thermal switches initiates the operation of the detonator and the explosion of the explosive material.

4. The automatic fire extinguisher according to claim 3 wherein the individual thermal switch is an electrical switching device;

wherein each individual thermal switch electrically connects in series between the battery and the detonator such that the closure of the individual thermal switch provides the electrical energy required by the detonator to detonate the explosive material.

5. The automatic fire extinguisher according to claim 4 wherein each individual thermal switch comprises a normally closed momentary switch, a switch compression spring, and a thermal epoxy detent;

wherein the normally closed momentary switch forms the series electrical connection between the battery and the detonator;

wherein the switch compression spring is a compression spring that holds the normally closed momentary switch in the closed position when the switch compression spring is in its relaxed shape;

wherein the thermal epoxy detent is an epoxy adhesive used to glue the switch compression spring of the normally closed momentary switch in a deformed position such that the normally closed momentary switch is fixed into an open position;

wherein the normally closed momentary switch further comprises a first lead and a second lead;

wherein the first lead is an electrical termination of the normally closed momentary switch;

wherein the second lead is an electrical termination of the normally closed momentary switch.

6. The automatic fire extinguisher according to claim 5 wherein the actuation of the normally closed momentary switch into an open position applies a compressive force to the switch compression spring such that the switch compression spring will return to its relaxed shape to close the normally closed momentary switch when the compressive force is removed.

7. The automatic fire extinguisher according to claim 6 wherein the thermal epoxy detent is formed from a thermal epoxy;

wherein the thermal epoxy detent melts at a predetermined temperature;

wherein the predetermined temperature of the thermal epoxy used in the thermal epoxy detent is the predetermined ambient temperature of the automatic fire extinguisher;

wherein when the temperature around the automatic fire extinguisher reaches the predetermined ambient temperature, the thermal epoxy forming the thermal epoxy detent melts thereby releasing the switch compression spring of the normally closed momentary switch to close the normally closed momentary switch.

8. The automatic fire extinguisher according to claim 7 wherein the first lead of the normally closed momentary switch of each individual thermal switch electrically connects to the positive terminal of the battery;

wherein the second lead of the normally closed momentary switch of each individual thermal switch electrically connects to the detonator.

9. The automatic fire extinguisher according to claim 8 wherein the plurality of thermal switches further comprises a first thermal switch, a second thermal switch, a third thermal switch, and a fourth thermal switch;

wherein the position first thermal switch monitors the temperature by a first quadrant of the exterior of the high-pressure gas tank;

wherein the position second thermal switch monitors the temperature by a second quadrant of the exterior of the high-pressure gas tank;

wherein the position third thermal switch monitors the temperature by a third quadrant of the exterior of the high-pressure gas tank;

wherein the position fourth thermal switch monitors the temperature by a fourth quadrant of the exterior of the high-pressure gas tank.

10. The automatic fire extinguisher according to claim 9 wherein the second thermal switch electrically connects in parallel with the first thermal switch;

wherein the third thermal switch electrically connects in parallel with the first thermal switch and the second thermal switch;

wherein the fourth thermal switch electrically connects in parallel with the first thermal switch, the second thermal switch, and the third thermal switch.

* * * * *